US009119007B2

(12) United States Patent
Chao et al.

(10) Patent No.: US 9,119,007 B2
(45) Date of Patent: Aug. 25, 2015

(54) METHOD OF AND HEARING AID FOR ENHANCING THE ACCURACY OF SOUNDS HEARD BY A HEARING-IMPAIRED LISTENER

(71) Applicant: Kuo-Ping Yang, Taipei (TW)

(72) Inventors: Kuan Li Chao, Taipei (TW); Neo Bob Chih Yung Young, Taipei (TW); Kuo Ping Yang, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 84 days.

(21) Appl. No.: 13/889,431

(22) Filed: May 8, 2013

(65) Prior Publication Data

US 2014/0023219 A1 Jan. 23, 2014

(30) Foreign Application Priority Data

Jul. 20, 2012 (TW) ..... 101126336 A

(51) Int. Cl.
*H04R 25/00* (2006.01)

(52) U.S. Cl.
CPC ..... *H04R 25/50* (2013.01); *H04R 25/353* (2013.01)

(58) Field of Classification Search
CPC ..... H04R 25/353; H04R 25/356
USPC ..... 381/316, 320
See application file for complete search history.

(56) References Cited

U.S. PATENT DOCUMENTS

| | | | | |
|---|---|---|---|---|
| 5,903,655 | A * | 5/1999 | Salmi et al. | 381/321 |
| 2007/0127748 | A1 * | 6/2007 | Carlile et al. | 381/312 |
| 2008/0069385 | A1 * | 3/2008 | Revit | 381/321 |

* cited by examiner

*Primary Examiner* — Curtis Kuntz
*Assistant Examiner* — Katherine Faley
(74) *Attorney, Agent, or Firm* — Bacon & Thomas, PLLC

(57) ABSTRACT

A method for enhancing the accuracy of sounds heard by a hearing-impaired listener is disclosed. The method for enhancing the accuracy of sounds heard by a hearing-impaired listener includes receiving an input sound, increasing or decreasing the energy of the high frequency section and then lowering the frequency of the high frequency section, and then combining the low high frequency section with the high frequency section of which the energy was increased/decreased and the frequency was lowered.

2 Claims, 3 Drawing Sheets

METHOD OF AND HEARING AID FOR ENHANCING THE ACCURACY OF SOUNDS HEARD BY A HEARING-IMPAIRED LISTENER

BACKGROUND OF THE INVENTION

1. Field of the Invention

The present invention relates to a method of and hearing aid for enhancing the accuracy of sounds heard by a hearing-impaired listener; more particularly, the present invention relates to a method of and hearing aid for enhancing the accuracy of sounds heard by a hearing-impaired listener by means of modifying the frequency of an input sound.

2. Description of the Related Art

The main concept of the hearing aid is to amplify sounds so as to help a hearing-impaired listener to hear previously-unheard sounds. As a result, the hearing-impaired listener can hear the voice of a speaker without the need for the speaker to raise his or her voice. However, the hearing-impaired listener cannot hear sounds with two specific characteristics: the frequency is too high, or the intensity is too low. For example, the sounds corresponding to the Mandarin phonetic symbols "ㄗ", "ㄘ" and "ㄙ" have such characteristics that the hearing-impaired listener has trouble hearing them. However, most conventional hearing aids, which only enhance the energy of the overall sound without identifying partial syllables that need to be enhanced, may cause sound distortion in the process of amplification. Related known prior arts regarding improving the sound by processing the frequency are briefly described hereinafter:

U.S. Pat. No. 7,305,100 discloses a "dynamic compression in a hearing aid" mainly used for minimizing a sound delay.

U.S. Pat. No. 4,454,609 discloses a "speech intelligibility enhancement" used for enhancing the consonant sounds of speech with high frequency. The greater the high frequency content relative to the low, the more such high frequency content is boosted. In this known prior art, consonant high frequency sounds are enhanced. However, it is very difficult to detect the occurrence of consonants in daily conversations. Therefore, this known prior art is not applicable for a hearing aid.

U.S. Pat. No. 4,759,071 discloses an "automatic noise eliminator for hearing aids" mainly used for noise elimination. It removes all sounds below a predetermined level and transmits a compressed sound range for all sounds above a predetermined level. The object of this known prior art is different from that of the present invention. Further, it may cause sound distortion after all sounds below the predetermined level are removed.

U.S. Pat. No. 6,577,739 discloses an "apparatus and methods for proportional audio compression and frequency shifting", which provides an understandable audio signal to listeners who have hearing loss in particular frequency ranges by proportionally compressing the audio signal. However, this known prior art compresses all audio signals, which may result in serious sound distortion.

U.S. Pat. No. 7,609,841 (hereinafter "the '841 patent") discloses a "frequency shifter for use in adaptive feedback cancellers for hearing aids", which improves a conventional frequency shifting method by means of applying frequency shifting only to the high frequency portion of the signal (which is shifted alternately upward and or downward), wherein the frequency shifting ratio is less than 6%. Although the frequency shifter of the '841 patent also applies frequency shifting to high frequency signals, it does not increase or decrease the energy of the high frequency signals.

U.S. Pat. No. 7,580,536 (hereinafter "the '536 patent") discloses a "sound enhancement for hearing-impaired listeners", which provides a method of enhancing sound heard by a hearing-impaired listener. The method of the '536 patent compresses high frequency sounds with energy greater than a predetermined threshold or shifts the high frequency sounds to a lower frequency range without altering low frequency sounds (such as normal human speaking frequencies). According to the embodiment of the '536 patent, the processed high frequency sounds are at 32 kHz (column 6, line 18), which is not a normal human speaking frequency. Furthermore, the specification of the '536 patent does not disclose the value of the "predetermined threshold".

Therefore, there is a need to provide a method of and hearing aid for enhancing the accuracy of sounds heard by a hearing-impaired listener that is capable of identifying sounds that need to be enhanced so as to modify the frequency accordingly, thereby mitigating and/or obviating the aforementioned problems. The applicant filed U.S. patent application Ser. No. 13/064,645 (Taiwan Patent Application Serial No. 099141772), which also discloses a "method and hearing aid of enhancing the accuracy of sounds heard by a hearing-impaired listener", whereas the present invention discloses another novel solution.

SUMMARY OF THE INVENTION

It is an object of the present invention to provide a method for enhancing the accuracy of sounds heard by a hearing-impaired listener.

It is another object of the present invention to provide a hearing aid for enhancing the accuracy of sounds heard by a hearing-impaired listener.

To achieve the abovementioned objects, the method for enhancing the accuracy of sounds heard by a hearing-impaired listener of the present invention comprises the following steps:

(A) Receiving an input sound, wherein the input sound includes a high frequency section and a lower frequency section.

(B) Increasing or decreasing the energy of the high frequency section To form a high frequency sound processing section.

(C) Lowering the frequency of the high frequency sound processing section to form a frequency-lowered high frequency sound-amplifying section.

(D) Combining the lower frequency section with the frequency-lowered high frequency sound-amplifying section to form a modified input sound.

(E) Outputting the modified input sound.

The key point of the present invention is to increase or decrease the energy of the high frequency section, next to lower the frequency of the high frequency section, and then to combine the non-high frequency section with the frequency-lowered high frequency sound-amplifying section to form the modified input sound.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
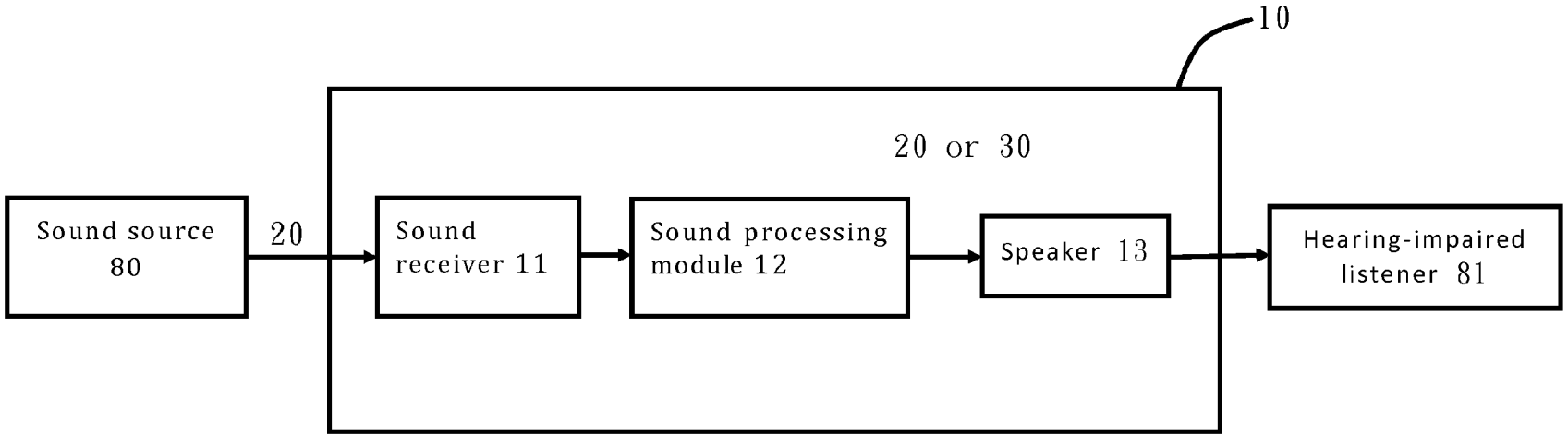
FIG. 1 illustrates a structural drawing of a hearing aid according to the present invention.

Please refer to FIG. 1, which illustrates a structural drawing of a hearing aid according to the present invention.

The hearing aid 10 of the present invention comprises a sound receiver 11, a sound processing module 12, and a speaker 13. The sound receiver 11 is used for receiving an input sound 20 from a sound source 80. The input sound 20 is processed by the sound processing module 12 for being outputted through the speaker 13. The sound receiver 11 can be a microphone or any other equivalent sound receiving equipment, and the speaker 13 can be an earphone or any other equivalent outputting equipment without being limited to the above scope. The sound processing module 12 is generally composed of a sound effect processing chip associated with a control circuit and an amplification circuit, or it can be composed of a solution including a processor and a memory associated with a control circuit and an amplification circuit. The purpose of the sound processing module 12 is to amplify sound signals, to filter out noises, to change the composition of the sound frequency, and to perform necessary processes according to the object of the present invention. Because the sound processing module 12 can be implemented by utilizing conventional hardware associated with new firmware or software, there is no need for further description of the hardware structure of the sound processing module 12. Basically, the hearing aid 10 of the present invention can be a hardware specialized dedicated device, or it can be, but is not limited to, a small computer such as a personal digital assistant (PDA), a PDA phone, a smart phone, and/or a personal computer.

Figure 2:
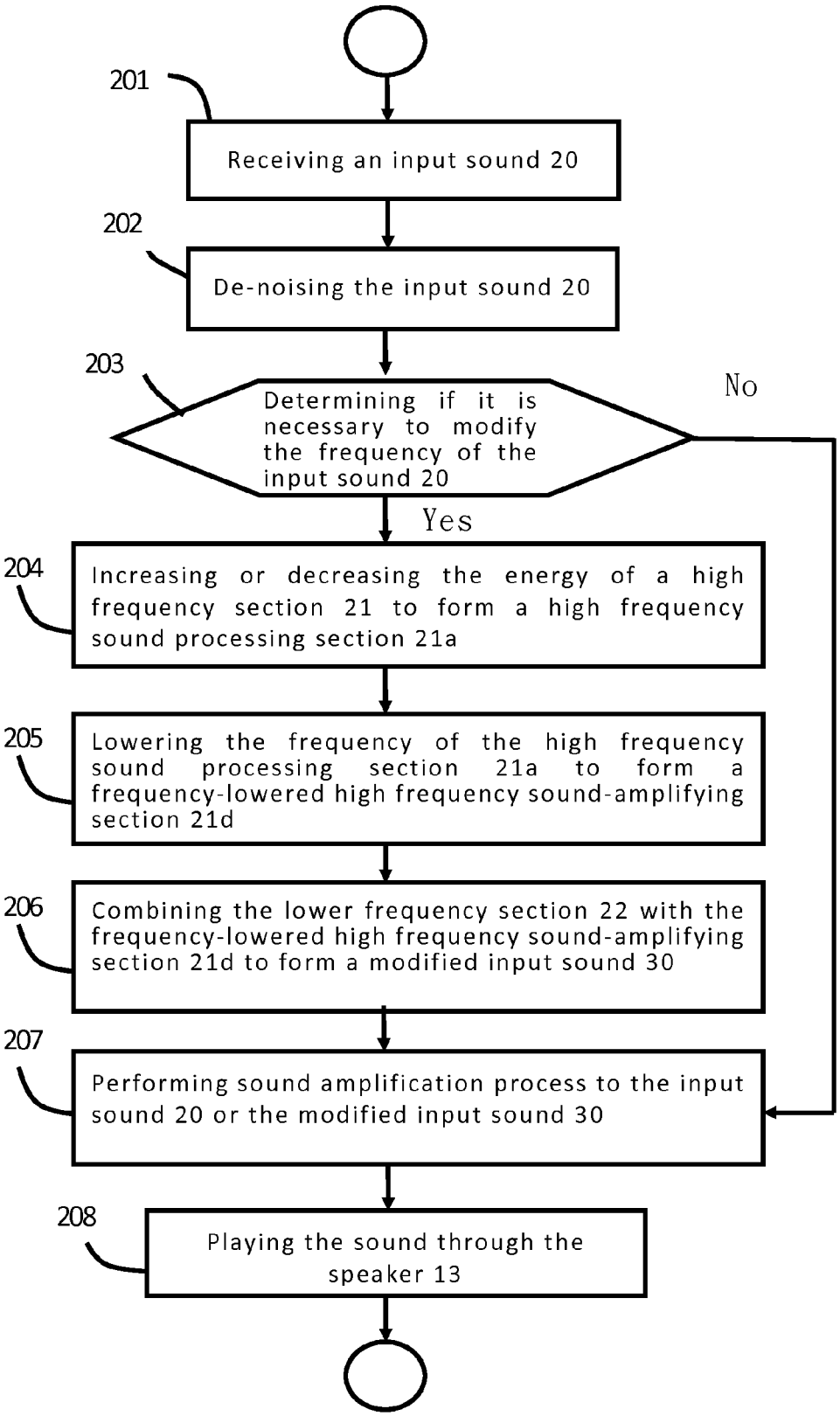
FIG. 2 illustrates a flowchart of a sound processing module according to the present invention.

Please refer to FIG. 2, which illustrates a flowchart of a sound processing module according to the present invention. Please also refer to FIGS. 3 to 6 according to related embodiments of the present invention.

Step 201: receiving an input sound 20.

This step is accomplished by the sound receiver 11, which receives the input sound 20 from the sound source 80.

Step 202: de-noising the input sound 20.

After the sound receiver 11 receives the input sound 20, the sound processing module 12 performs a de-noising process first. Because the de-noising process is a known technique, there is no need for further description.

Step 203: determining if it is necessary to modify the frequency of the input sound 20.

The sound processing module 12 determines if it is necessary to modify the frequency of the input sound 20 according to preset conditions. In Chinese/Mandarin speech, for example, the pronunciation covers multiple frequencies, including low, medium, and high frequencies, wherein the pronunciation energies of most Mandarin phonetic symbols are distributed in a low frequency range of 20~1000 Hz. However, the energies of some Mandarin sounds, such as those represented by the phonetic symbols "ㄗ", "ㄘ" or "ㄙ" (hereinafter the sounds "ㄗ", "ㄘ" or "ㄙ"), whose proportion of the sound energy within the low frequency range is comparatively low, are mostly distributed in the medium/high frequency portion. Generally, it is very difficult for a hearing-impaired listener to sense/notice high frequency sounds (such as those over 6000 Hz). That is, compared to the low frequency sounds, the high frequency sounds "ㄗ", "ㄘ" or "ㄙ" need to be outputted at a louder volume so that the hearing-impaired listener will have a better chance of hearing them. However, if the overall sound is outputted at a louder volume, the hearing-impaired listener may feel that the low frequency sound is too loud. Therefore, the method of amplifying the sound as a whole cannot solve the practical problem. Moreover, even if a filtering technique is applied to enhance the high frequency energy only, such a technique might still result in the problem that the hearing-impaired listener hears nothing even when the energy has already been increased to greater than a pain threshold of the hearing-impaired listener.

In some known prior art techniques, such as U.S. Pat. No. 6,577,739, the frequencies of all sounds are lowered first, and then the sound energies are amplified for being outputted to the hearing-impaired listener. However, although such a technique can help the hearing-impaired listener to hear sounds which were originally at a high frequency, the sounds are seriously distorted because all sound frequencies are lowered (including those sounds which could be heard originally), which causes inconvenience for a hearing-impaired listener who is attempting to learn correct pronunciation.

The object of the method of enhancing the accuracy of sounds heard by a hearing-impaired listener of the present invention is to lower the frequency of the sound segment with more high frequency energy. The input sound 20 necessary for frequency modification is characterized in that:

If the digital signal sampling rate of a sound is 44100 Hz, the proportion ($\rho_{0m}$) of the sound energy over 1000 Hz of the input sound 20 to all sound energy of the input sound 20 is greater than 70%, and the proportion ($\rho_{1m}$) of the sound energy under 2000 Hz of the input sound 20 to all sound energy of the input sound is less than 20%. If the input sound 20 meets these two criteria, the input sound 20 is distributed in the high frequency portion that is not easily heard by the hearing-impaired listener. Therefore, frequency modification is necessary.

Figure 3:
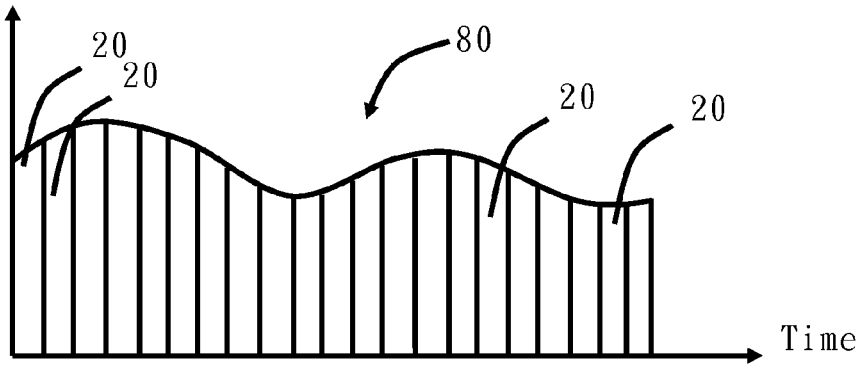
FIG. 3 illustrates a schematic drawing of dividing a sound source into a plurality of input sounds according to the present invention.
Figure 4:
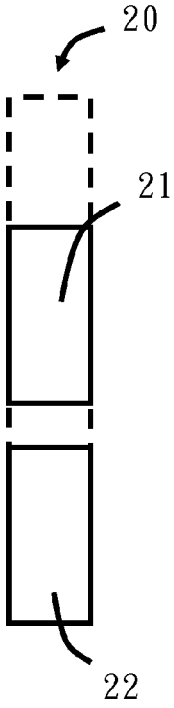
FIG. 4 illustrates a schematic drawing of classifying the input sound into a high frequency section and a lower frequency section.
Figure 5:
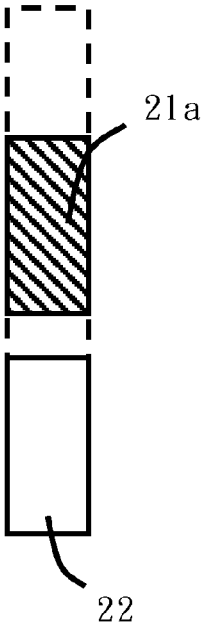
FIG. 5 illustrates a schematic drawing of processing the high frequency section as a high frequency sound processing section.

In step 203, this determination can be accomplished in practice in many ways. In order to rapidly (such as within 0.01 second) determine if it is necessary to perform step 204, the method inspects the energy of the frequency every 1024 frames and then utilizes fuzzy logic to determine if the input sound 20 meets the above two conditions. FIG. 3 illustrates a schematic drawing of dividing the sound source 80 into a plurality of input sounds 20 according to the present invention. It is suggested that each input sound 20 be processed through the determination of step 203. Such a determination can be made with many ways of mathematical calculation. Because the object of the present invention is not to improve the mathematical calculation models, there is no need for further description. Please note that different thresholds can be set for the determination of step 203. The above two conditions are conservative thresholds after an experimental calculation. If stricter thresholds are required, the above two conditions are suggested as follows:

Take the sound combination represented by the Mandarin phonetic symbols "ㄅㄚˊ" as an example. The sound energy of "ㄅㄚˊ" is distributed within the range of 1000~2000 Hz. After calculation, $\rho_{1m}$ is about 95%, and therefore no frequency modification is applied to "ㄅㄚˊ".

Take the sound combination represented by the Mandarin phonetic symbols "ㄙㄠ" as an example. The initial sound is "ㄙ", wherein its $\rho_{0m}$ is 99.8%, which is greater than 70%, and its $\rho_{1m}$ is 5%, which is less than 20%. As a result, the initial sound "ㄙ" is very difficult for the hearing-impaired listener to hear, and its frequency needs to be modified.

Basically, according to the experimental results for most hearing-impaired listeners, the frequency of a high frequency section is between 1000 Hz and 14000 Hz, and the frequency of a lower frequency section is between 0 Hz and 6000 Hz.

In step 203, if it is determined that the input sound 20 requires frequency modification, the method will perform step 204; otherwise, the method will perform step 207.

Step 204: increasing or decreasing the energy of a high frequency section 21 to form a high frequency sound processing section 21*a*.

The input sound 20 that needs to be processed by step 203 comprises a high frequency section 21 and a lower frequency section 22. For example, after being processed by step 203, the section of 8000~14000 Hz of the input sound 20 is determined as the high frequency section 21 (wherein the section over 14000 Hz is a meaningless section), and the section under 8000 Hz is determined as the lower frequency section 22. Because there are various ways of calculating or defining the high frequency section 21, the high frequency section 21 can be adjusted according to the conditions of different hearing- impaired listeners (for example, for some hearing-impaired listeners, the section of 6000~14000 Hz would be determined as the high frequency section 21, and the section under 6000 Hz would be determined as the lower frequency section 22), and the above embodiment is only one example not intended to limit the scope of the present invention. The object of the present invention is to increase or decrease the energy of the high frequency section 21 to form a high frequency sound processing section 21*a*, such as amplifying the high frequency section 21 to five times the original volume in order to form the high frequency sound processing section 21*a*, as shown in the schematic drawing of FIG. 5.

Please note that the high frequency sound processing section 21*a* is not necessarily formed by increasing the energy of the high frequency section 21. Sometimes the energy will be decreased according to different frequencies. However, basically, some energy in the high frequency section 21 will be increased. Take the high frequency section 21 of 8000~14000 Hz as an example; if the target frequency of step 205 is 0~6000 Hz (by means of lowering the frequency for 8000 Hz) but the hearing-impaired listener can only hear frequencies under 3000 Hz, the original frequency of 11000~14000 Hz can be filtered (which means the energy of 11000~14000 Hz is decreased); this example explains the step of "increasing or decreasing the energy" in step 204.

Step 205: lowering the frequency of the high frequency sound processing section 21*a* to form a frequency-lowered high frequency sound-amplifying section 21*d*.

Figure 6:
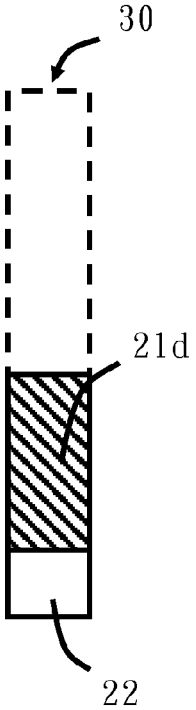
FIG. 6 illustrates a schematic drawing of lowering the frequency of the high frequency sound processing section to form a frequency-lowered high frequency sound-amplifying section and thereby forming an improved input sound according to one embodiment by means of frequency shifting.
Figure 7:
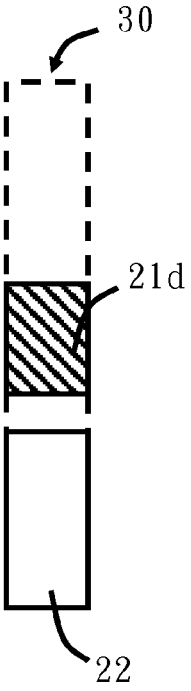
FIG. 7 illustrates a schematic drawing of lowering the frequency of the high frequency sound processing section to form a frequency-lowered high frequency sound-amplifying section and thereby forming the improved input sound according to another embodiment by means of frequency compression.

Generally speaking, the method for lowering the frequency mainly includes frequency shifting, frequency compression, or a combination thereof The primary function of this step is to lower the frequency of the high frequency sound processing section 21*a* so that the hearing-impaired listener can hear the sound. FIG. 6 illustrates a schematic drawing of performing frequency shifting to form the frequency-lowered high frequency sound-amplifying section 21*d;* FIG. 7 illustrates a schematic drawing of performing frequency compression to form the frequency-lowered high frequency sound-amplifying section 21*d*. Because the technique of lowering the frequency is well known by those skilled in related art, there is no need for further description.

Step 206: combining the lower frequency section 22 with the frequency-lowered high frequency sound-amplifying section 21*d* to form (synthesize) a modified input sound 30, as shown in FIG. 6 and FIG. 7. Please note that basically the frequency of the lower frequency section 22 cannot be modified (such as lowering its frequency); however, in order to provide better speech quality processing, the frequency can be modified as well. Therefore, the lower frequency section 22 as disclosed in this specification and claims can be a processed or a non-processed section.

Step 207: performing a sound amplification process on the input sound 20 or the modified input sound 30.

In step 203, if it is determined that it is not necessary to modify the frequency of the input sound 20, the method performs step 207 to perform a sound amplification process on the input sound 20. If step 207 is performed right after step 206, then the method performs a sound amplification process on the modified input sound 30.

Basically, the sound provided to the hearing-impaired listener 81 needs to be amplified, and even the lower frequency section 22 needs to be amplified. The purpose of the present invention is to increase or decrease the energy of the high frequency section 21 (step 204), next to lower the frequency of the high frequency section 21 (step 205), and then to combine the lower frequency section 22 with the frequency-lowered high frequency sound-amplified section 21*d* to form the modified input sound 30. Generally speaking, the modified input sound 30 still needs to undergo sound amplification. However, according the condition of the hearing-impaired listener, it is possible that step 207 can be skipped.

Step 208: speaker 13 playing the sound.

The speaker 13 then plays the sound processed (step 207) by the sound processing module 12.

Please note that the hearing aid 10 should be able to process the sound rapidly, such that the hearing-impaired listener 81 can hear the sound on an almost simultaneous basis. Therefore, the sound length of the input sound 20 should be as short as possible so as to reduce the delay time. For example, the above method is performed every 0.01 second; practically, the length of each input sound 20 is thus 0.01 second. If the duration of "ㄙㄠ" is 1 second, the method will perform 100 determinations (by performing a determination for every 0.01 second of sound on a first-in-first-out basis). If the duration of the initial syllable "ㄙ" is 0.1 second and the duration of other syllable is 0.9 second, the first 10 input sounds 20 will be modified into the modified input sounds 21, and the last 90 input sounds 20 will not be modified into the modified input sounds 21.

With regard to the phrase "ㄗㄠˇ ㄢ", the hearing-impaired listener wearing a conventional hearing aid will easily recognize the output sound as "ㄠˇ ㄢ", which explains why the hearing-impaired listener will say "ㄠˇ ㄢ" instead of "ㄗㄠˇ ㄢ". However, in the simulated experiment of the present invention, the output sound of the sound "ㄗㄠˇ ㄢ" heard by the hearing-impaired listener is very close to "ㄗㄠˇ ㄢ" without distortion.

The abovementioned technique can also be applied in other languages. According to experimental results, the present invention is especially beneficial to words with short syllables, such as Chinese, Japanese, and Korean. In Chinese/Mandarin, for example, each word comprises at most three syllables. The present invention is less beneficial to multi-syllable languages such as English. However, because all languages have short syllables, the hearing-impaired listener would easily pronounce, for example, the English word "say" as "ay". As shown in the simulated experiment of the present invention, the output sound of the sound "say" heard by the hearing-impaired listener will be very close to "say" without distortion.

Although the present invention has been explained in relation to its preferred embodiments, it is to be understood that many other possible modifications and variations can be made without departing from the spirit and scope of the invention as hereinafter claimed.

What is claimed is:

1. A method for enhancing the accuracy of sounds heard by a hearing-impaired listener, comprising steps of:

inputting a sound to a hearing aid;

determining whether the input sound meets a criterion wherein a proportion of a sound energy over 1000 Hz of the input sound to all sound energy of the input sound is greater than 70%; and a proportion of a sound energy under 2000 Hz of the input sound to all sound energy of the input sound is less than 20%;

if the input sound meets said criterion, performing steps (A)-(E) as follows:

(A) receiving an input sound, wherein the input sound includes a high frequency section and a lower frequency section, wherein the frequency of the high frequency section is between 1000 Hz and 14000 Hz, and the frequency of the lower frequency section is between 0 Hz and 6000 Hz;

(B) increasing the energy of the high frequency section to form a high frequency sound processing section;

(C) lowering the frequency of the high frequency sound processing section to form a frequency-lowered high frequency sound-amplifying section;

(D) combining the lower frequency section with the frequency-lowered high frequency sound-amplifying section to form a modified input sound; and (E) outputting the modified input sound.

2. The method for enhancing the accuracy of sounds heard by a hearing-impaired listener as claimed in claim 1, wherein in step (E), the modified input sound is outputted after undergoing energy amplification.

* * * * *